US010499733B2

(12) United States Patent
Felsenthal et al.

(10) Patent No.: US 10,499,733 B2
(45) Date of Patent: Dec. 10, 2019

(54) SHOE RACK

(71) Applicant: Whitmor, Inc., Southaven, MS (US)

(72) Inventors: Sandy Felsenthal, Memphis, TN (US); Steve Westcott, Memphis, TN (US); Milton D. Ruiz, Germantown, TN (US); Paul Mann, Oak Park, IL (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 15/461,208

(22) Filed: Mar. 16, 2017

(65) Prior Publication Data

US 2018/0132612 A1 May 17, 2018

Related U.S. Application Data

(63) Continuation-in-part of application No. 29/584,524, filed on Nov. 15, 2016, now Pat. No. Des. 841,374.

(51) Int. Cl.

| | |
|---|---|
| ***A47B 61/04*** | (2006.01) |
| ***A47B 47/00*** | (2006.01) |
| ***A47B 55/02*** | (2006.01) |
| ***A47B 47/02*** | (2006.01) |

(52) U.S. Cl.

CPC ..... *A47B 61/04* (2013.01); *A47B 47/00* (2013.01); *A47B 47/024* (2013.01); *A47B 55/02* (2013.01); *A47B 47/027* (2013.01)

(58) Field of Classification Search

CPC ..... A47B 43/003; A47B 61/04; A47B 96/06; A47B 55/02; A47B 96/061; A47B 47/00; A47B 47/024; A47B 47/027

USPC ..... 211/33, 34, 36, 37, 41.4, 133.2, 133.5, 211/187, 134, 186, 181.1; 108/92, 101, 108/181, 193; 248/235, 249, 250, 302

See application file for complete search history.

(56) References Cited

U.S. PATENT DOCUMENTS 440,439 A * 11/1890 Saunders ..... A47F 7/08 211/34
595,196 A * 12/1897 Newman ..... A47F 7/08 211/34
726,527 A * 4/1903 Hager ..... A47G 25/10 211/30

(Continued)

FOREIGN PATENT DOCUMENTS

GB 2326329 A * 12/1998 ..... A47B 57/20
GB 2326329 A * 12/1998 ..... A47B 57/20

*Primary Examiner* — Jonathan Liu
*Assistant Examiner* — Devin K Barnett
(74) *Attorney, Agent, or Firm* — Stites & Harbison PLLC; Richard S. Myers, Jr.

(57) ABSTRACT

A shoe rock for holding organizing and holding shoes is provided. The shoe rack may include a base detachably connected to a first side rail and a second side rail, the first side rail and the second side rail extending upward from the base at an angle from 45 degrees to less than 90 degrees; and a plurality of shelves, each shelf comprising (a) a shelf platform; (b) a first joint detachably connected to the first side rail; and (c) a second joint detachably connected to the second side rail. The plurality of shelves can be at least three shelves. In addition, the present invention may include a kid for a shoe rack that includes a base, a first and second side rail, where each side rail has an angled first end that has an angle from 45 degrees to less than 90 degrees, a plurality of shelves that each has a platform, a first joint and a second joint and includes a plurality of fasteners.

8 Claims, 13 Drawing Sheets

(56) References Cited

U.S. PATENT DOCUMENTS 1,374,592 A * 4/1921 Locke ..... A43D 117/00 211/34
1,710,940 A * 4/1929 Murphy ..... A43D 117/00 211/36
1,962,970 A * 6/1934 Ple ..... A43D 111/00 12/1 A
2,315,595 A * 4/1943 Chappory ..... A47F 5/13 211/149
2,433,748 A * 12/1947 Eide ..... A47F 5/10 108/101
2,495,109 A * 1/1950 Kramer ..... A47F 5/12 211/128.1
D160,378 S * 10/1950 Falkenberg et al. ..... 211/181.1
2,605,905 A * 8/1952 Willmott ..... A43D 117/00 211/34
2,648,442 A * 8/1953 Lowmaster ..... A47F 5/01 108/1
2,729,341 A * 1/1956 Freeman ..... A43D 117/00 211/37
2,886,186 A * 5/1959 Hamilton ..... A47B 31/00 108/189
2,896,789 A * 7/1959 Sans ..... A47G 25/0664 108/28
2,969,155 A * 1/1961 Atkinson ..... A47B 55/02 211/189
3,145,850 A * 8/1964 Ciborowski ..... A47F 5/01 108/27
3,171,541 A * 3/1965 Weisberger ..... A47F 5/01 211/182
3,361,088 A * 1/1968 Hodgkin ..... A47B 9/00 108/12
3,367,510 A * 2/1968 Krikorian ..... A47F 5/13 211/126.1
3,387,855 A * 6/1968 Oliver ..... A47B 55/02 211/133.2
3,502,225 A * 3/1970 Oliver ..... A47F 5/0031 108/181
3,532,224 A * 10/1970 Grubb ..... A47F 5/13 211/118
4,108,316 A * 8/1978 Slater ..... A47F 5/13 211/182
4,109,797 A * 8/1978 Brunette ..... A47F 5/12 108/108
D249,615 S * 9/1978 Frisbey ..... D6/675.2
4,122,955 A * 10/1978 Celms ..... A47F 5/13 108/108
4,159,122 A * 6/1979 Stevens ..... B60R 3/02 108/134
4,257,333 A * 3/1981 Pollack ..... A47B 57/265 108/147.13
4,501,369 A * 2/1985 Fox ..... A47B 57/26 108/147.12
D295,931 S * 5/1988 Bezzerides ..... D6/675.2
4,852,839 A * 8/1989 Winter ..... A47B 57/485 211/192
4,919,280 A * 4/1990 Phillips ..... A47F 5/08 211/187
D310,623 S * 9/1990 Aranibar ..... 248/250
4,953,715 A * 9/1990 Celli ..... A47G 25/005 211/34
5,061,000 A * 10/1991 Haugen ..... B60P 3/42 285/404
5,088,420 A * 2/1992 Russell ..... A47B 21/00 108/106
5,303,645 A * 4/1994 Meacham ..... A47B 57/545 108/147.13
D348,789 S * 7/1994 Bezzerides ..... D6/678.3
5,326,062 A * 7/1994 Remmers ..... A47B 55/02 211/106
5,326,337 A * 7/1994 Pardella ..... A63B 9/00 403/170
5,354,025 A * 10/1994 McCaffrey ..... A47B 57/44 108/156
5,695,080 A * 12/1997 Martin ..... A47B 55/02 211/183
5,752,610 A * 5/1998 Remmers ..... A47B 55/02 108/181
5,829,501 A * 11/1998 DeVito ..... B25H 1/02 108/162
5,878,802 A * 3/1999 Richter ..... A47G 5/00 160/135
D417,108 S * 11/1999 Von Gunten ..... D6/705.6
5,996,822 A * 12/1999 Hopkins ..... A47B 47/00 108/92
D418,342 S * 1/2000 Von Gunten ..... D6/705.6
6,089,387 A * 7/2000 Varfolomeeva ..... A47B 57/06 211/106
6,119,881 A * 9/2000 Yang ..... A47B 55/02 108/147.13
6,173,847 B1 * 1/2001 Zellner, III ..... A47B 55/02 211/186
6,196,401 B1 * 3/2001 Brady ..... A47F 1/121 211/186
D445,617 S * 7/2001 Von Gunten ..... D25/69
6,321,920 B1 * 11/2001 Pan ..... A47K 10/10 211/100
6,491,173 B1 * 12/2002 Costa ..... A47B 88/427 211/126.15
6,659,294 B1 * 12/2003 Simard ..... A47F 5/01 108/147.11
D495,523 S * 9/2004 Harwanko ..... D6/681.1
6,805,641 B2 * 10/2004 Pope ..... A63B 69/0057 473/274
6,817,478 B2 * 11/2004 Venegas, Jr. ..... A47B 83/001 211/182
D533,372 S * 12/2006 Glassenberg ..... D6/678.1
7,270,339 B2 * 9/2007 Feick ..... A47F 5/137 211/186
8,025,163 B2 * 9/2011 McAllister ..... A47B 96/028 108/42
8,079,313 B2 * 12/2011 Sparkowski ..... A47F 5/0018 108/110
8,210,371 B2 * 7/2012 Kim ..... F25D 25/022 211/126.15
8,616,138 B1 * 12/2013 Fu ..... A47B 57/545 108/147.13
8,960,458 B1 * 2/2015 Klein ..... A47B 87/0261 211/126.11
D727,067 S * 4/2015 Cohen ..... D6/548
9,585,469 B2 * 3/2017 Huang ..... A47B 47/021
9,648,949 B1 * 5/2017 Penaflor ..... A47B 81/00
2001/0032642 A1 * 10/2001 Bach ..... A47J 37/0763 126/519
2003/0085191 A1 * 5/2003 Nakajima ..... A47B 13/003 211/186
2005/0092701 A1 * 5/2005 Metcalf ..... A47F 5/137 211/59.2
2005/0230332 A1 * 10/2005 Taylor ..... A47F 7/08 211/34
2006/0032829 A1 * 2/2006 Hutzler ..... A47B 13/02 211/187
2006/0144805 A1 * 7/2006 Wang ..... A47B 57/04 211/37
2006/0175495 A1 * 8/2006 Gregory ..... A47B 96/028 248/250
2010/0243591 A1 * 9/2010 Kessell ..... A47B 57/26 211/134
2011/0240571 A1 * 10/2011 Ho ..... A47B 47/021 211/13.1
2011/0253659 A1 * 10/2011 Jarvis ..... A47B 47/045 211/153
2011/0290750 A1 * 12/2011 Lim ..... A47B 47/00 211/153
2012/0084916 A1 * 4/2012 Flannery ..... A47C 21/08 5/426
2013/0307285 A1 * 11/2013 Richter ..... B60P 1/64 296/24.44

(56) References Cited

U.S. PATENT DOCUMENTS

| | | | | |
|---|---|---|---|---|
| 2014/0001136 | A1* | 1/2014 | Yeh | A47B 47/00 211/186 |
| 2014/0097148 | A1* | 4/2014 | Cheng | A47B 61/04 211/34 |
| 2014/0190915 | A1* | 7/2014 | McBride | B68C 1/002 211/85.11 |
| 2014/0353271 | A1* | 12/2014 | Kruse | A47F 5/01 211/188 |
| 2015/0053632 | A1* | 2/2015 | Brinton, Jr. | A47B 96/02 211/134 |
| 2015/0359335 | A1* | 12/2015 | Offerman | A47B 96/021 211/153 |
| 2016/0183682 | A1* | 6/2016 | Tang | A47B 96/021 211/134 |
| 2016/0198850 | A1* | 7/2016 | Wall | A47B 87/0207 211/36 |
| 2016/0249783 | A1* | 9/2016 | Oh | A47J 47/16 211/41.4 |
| 2016/0340927 | A1* | 11/2016 | Rizzotto | E04H 15/32 |
| 2016/0356009 | A1* | 12/2016 | Pieper-Bailey | E01H 5/02 |
| 2017/0119152 | A1* | 5/2017 | Zhu | A47B 61/04 |
| 2017/0224107 | A1* | 8/2017 | Freelander | A47B 96/06 |

* cited by examiner

SHOE RACK

CROSS-REFERENCE TO RELATED APPLICATIONS

This application claims priority to U.S. application Ser. No. 29/584,524, filed on Nov. 15, 2016 to Sandy Felsenthal, Steve Westcott, Milton D. Ruiz, and Paul Mann entitled "SHOE RACK" the entire disclosure of which is incorporated herein by reference.

BACKGROUND

The present disclosure relates to footwear storage.

Shoe racks are a popular item because they represent a relatively simple way to create additional space in a closet or other room. Traditional floor-stand shoe racks have two side rails extending perpendicular to a base, and shelves vertically stacked on top of one another that are attached to the side rails. When the shelves are vertically stacked on top of one another and attached to side rails that are perpendicular to a base (i.e., perpendicular to the floor), users cannot view shoes stored on shelves other than the top-most shelf without bending down to view the lower shelf s contents. Moreover, traditional floor-stand shoe racks are known to be complicated and expensive to manufacture, and are cumbersome to transport. Others are difficult for a user to assemble.

A need exists for a shoe rack, and further a floor-stand shoe rack, that allows a user to view shoes stored on each shelf without bending down.

A need also exists for a shoe rack, and further a floor-stand shoe rack, that is simple and inexpensive to manufacture, and easy to transport by having a compact packaging size. A need further exists for a shoe rack that is simple for a user to assemble after purchase.

SUMMARY OF THE INVENTION

The present invention is directed generally to a shoe rack configured for storing and organizing shoes. The shoe rack may include a base detachably connected to a first side rail and a second side rail, the first side rail and the second side rail extending upward from the base at an angle from 45 degrees to less than 90 degrees; and a plurality of shelves, each shelf comprising (a) a shelf platform; (b) a first joint detachably connected to the first side rail; and (c) a second joint detachably connected to the second side rail. The plurality of shelves can be at least three shelves.

In addition, the present invention may include a kid for a shoe rack that includes a base, a first and second side rail, where each side rail has an angled first end that has an angle from 45 degrees to less than 90 degrees, a plurality of shelves that each has a platform, a first joint and a second joint and includes a plurality of fasteners.

Other aspects and advantages of the present invention will be apparent from the following detailed description of the preferred embodiments and the accompanying drawings figures.

DETAILED DESCRIPTION

As described below, the present disclosure provides a shoe rack. The shoe rack includes:

a base detachably connected to a first side rail and a second side rail, the first side rail and the second side rail extending upward from the base at an angle from 45 degrees to less than 90 degrees; and a plurality of shelves, each shelf comprising (a) a shelf platform;

(b) a first joint detachably connected to the first side rail; and (c) a second joint detachably connected to the second side rail.

Figure 1:
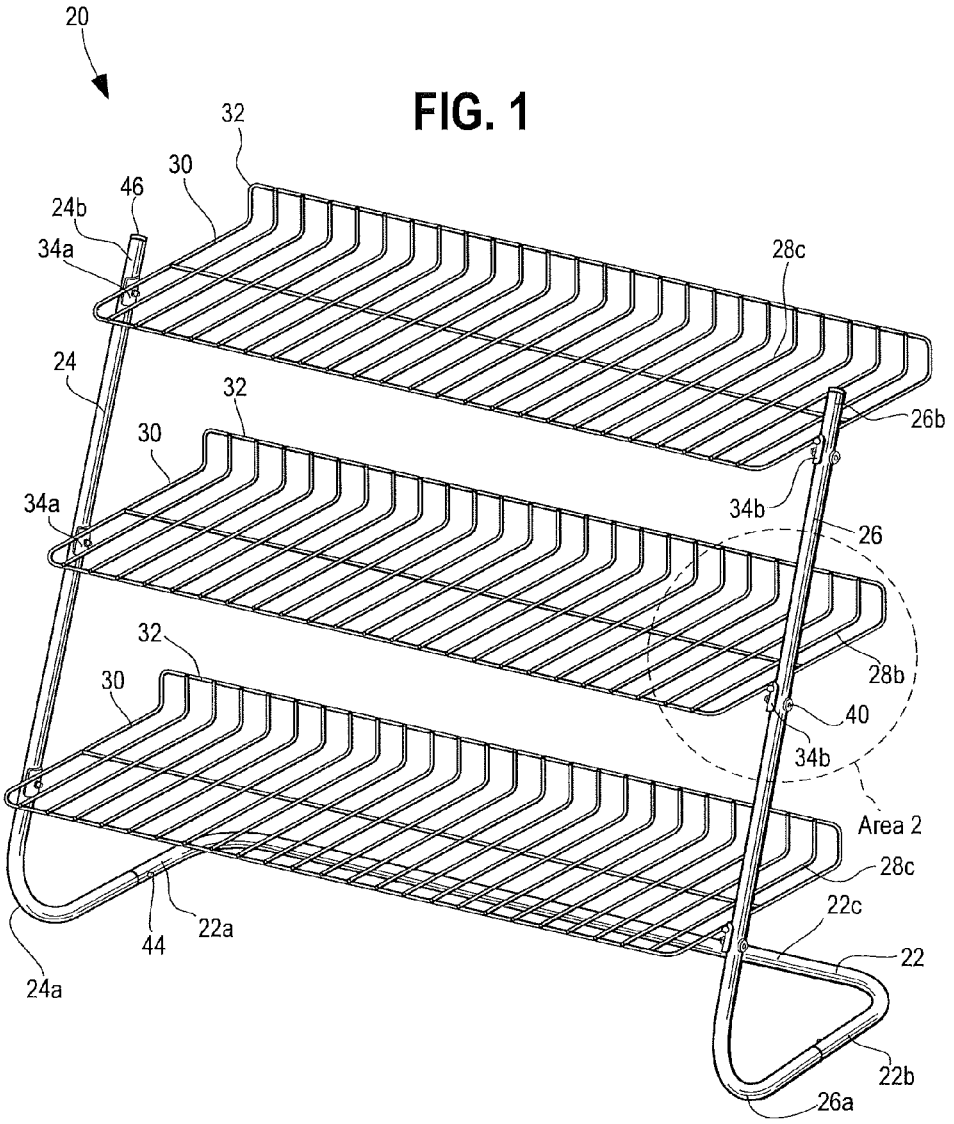
FIG. 1 is a perspective view of a shoe rack in accordance with an embodiment of the present disclosure.

Referring to FIG. 1, a shoe rack, and further a floor-stand shoe rack 20 is provided. A "floor-stand" shoe rack is an apparatus configured to store shoes when the apparatus is located on the ground (i.e., the floor). The floor-stand shoe rack is distinct from hanging shoe racks, such as those with hooks that are configured to hang on a door.

A. Base

Figure 6:
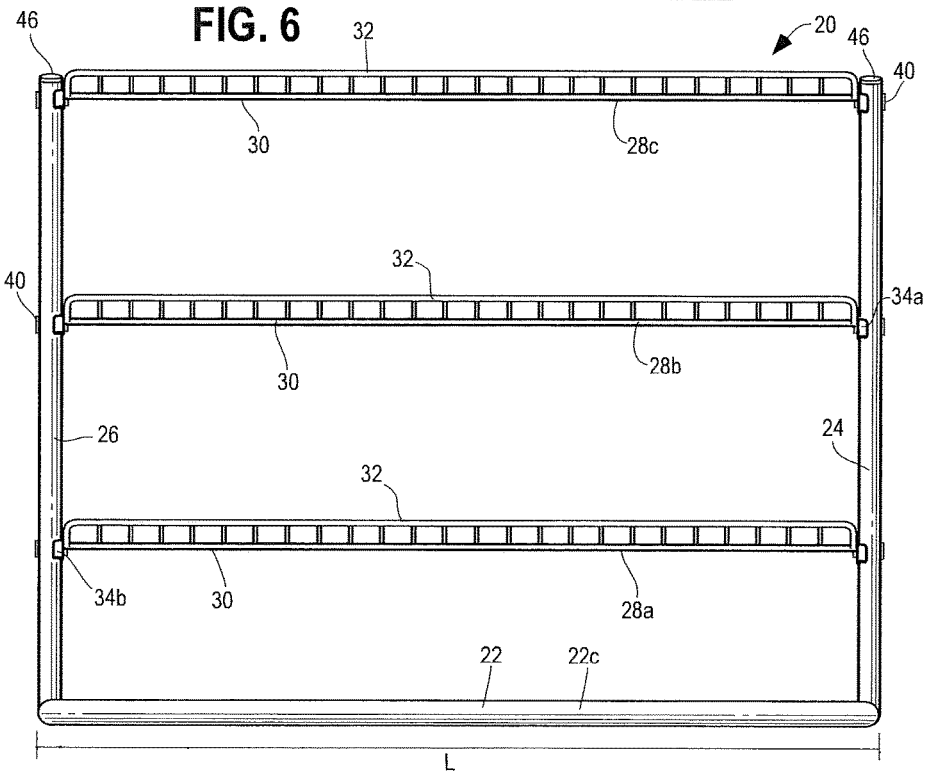
FIG. 6 is a rear elevation view of the shoe rack in accordance with an embodiment of the present disclosure.

The shoe rack 20 includes a base 22. The base 22 has a first end 22*a*, a second end 22*b*, and a rear side 22*c*. The first end 22*a* and the second end 22*b* are located at opposing ends of the base 22, with the rear side 22*c* located between the first end 22*a* and the second end 22*b*. The rear side 22*c* of the base 22 extends the length, L, of the shoe rack 20, as shown in FIG. 6.

Figure 10A:
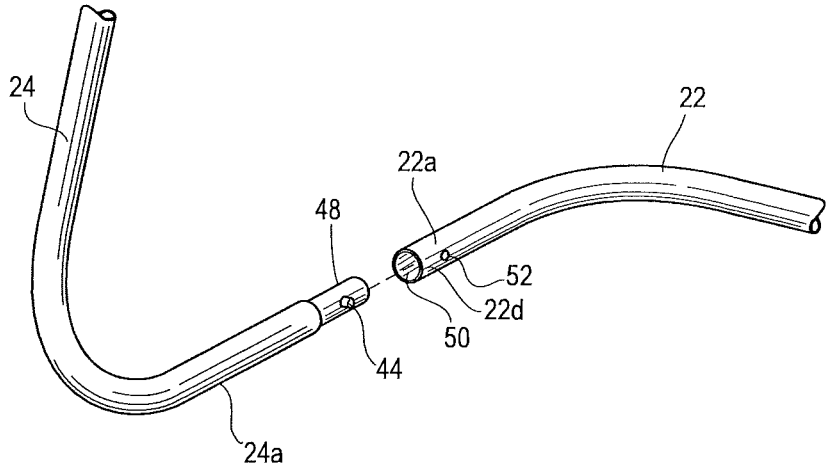
FIG. 10A is an enlarged exploded view of Area 10 of the shoe rack in accordance with an embodiment of the present disclosure.

In an embodiment, the base 22 is in the form of a tube with a circular cross-section, as shown in FIGS. 1 and 10A. While the present disclosure describes a base 22 in the form of a tube with a circular cross-section, it is understood that the base may be in other forms, such as in the form of a tube with a polygonal shape cross-section, a tube with an oval cross-section, or a tube with an ovoid cross-section. A "polygonal shape" is a closed-plane figure counted by at least three sides. Nonlimiting examples of suitable polygonal shapes include triangle, square, rectangle, and octagon. A "tube" includes hollow and solid (i.e., non-hollow) lengths of material. In an embodiment, the base 22 is in the form of a hollow tube with a circular cross-section, as shown in FIGS. 1 and 10A. The base 22 may be formed from a rigid material such as a metal or a polymeric material.

Figure 9:
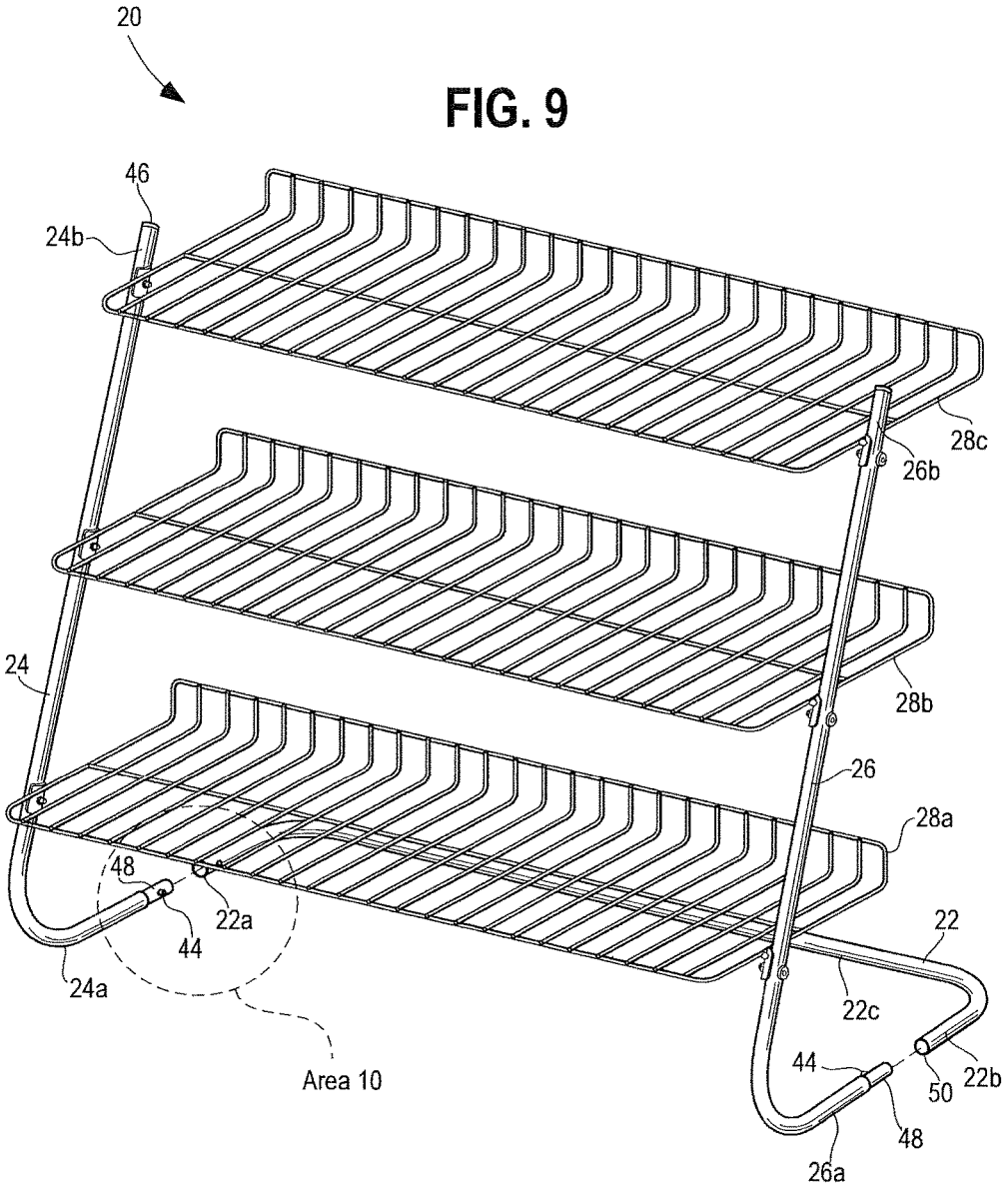
FIG. 9 is an exploded perspective view of the shoe rack in accordance with an embodiment of the present disclosure.
Figure 10B:
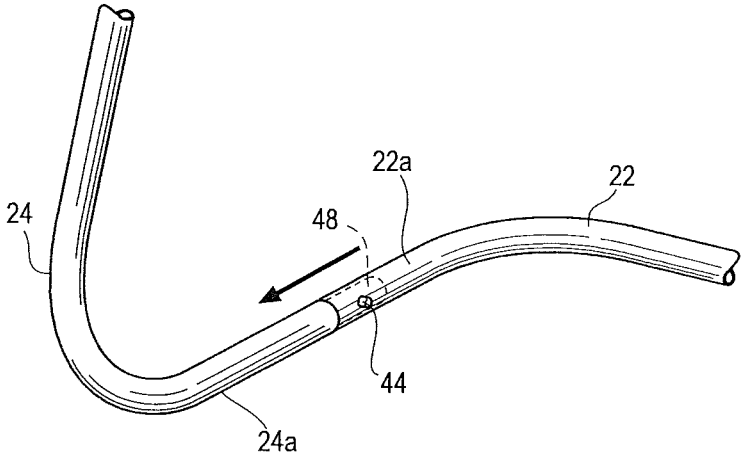
FIG. 10B is an enlarged view of Area 10 of the shoe rack in accordance with an embodiment of the present disclosure.

In an embodiment, the first end 22*a* of the base 22 includes a connector, such as a female connector or a male connector. FIGS. 9-10B depict a base 22 with a first end 22*a* having a female connector 50. In an embodiment, the second end 22*b* of the base 22 includes a connector, such as a female connector or a male connector. The first end 22*a* and the second end 22*b* of the base 22 may or may not have the same type of connector. In an embodiment, the first end 22*a* and the second end 22*b* of the base 22 each has a female 50 connector.

In an embodiment, the base 22 is in the form of a hollow tube with a circular cross-section, and the first end 22*a* of the base 22 includes an opening, such as a push-pin opening 52, in a wall 22*d* of the tube, as shown in FIG. 10A. In an embodiment, the base 22 is in the form of a hollow tube with a circular cross-section, and the second end 22*b* of the base 22 includes a push-pin opening 52 in a wall 22*d* of the tube. In an embodiment, the first end 22*a* and the second end 22*b* of the base 22 each has a push-pin opening 52 in the wall 22*d* of the tube. In another embodiment, either the first end 22*a* or the second end 22*b* of the base 22 has a push-pin opening 52 in the wall 22*d* of the tube.

B. Side Rails

Returning to FIG. 1, the base 22 is detachably connected to a first side rail 24 and a second side rail 26.

In an embodiment, the first side rail 24 and the second side rail 26 each is in the form of a tube with a circular cross-section, as shown in FIGS. 1 and 10A. While the present disclosure describes a first side rail 24 and a second side rail 26 in the four of a tube with a circular cross-section, it is understood that the side rails 24, 26 may be in other forms, such as in the four of a tube with a polygonal shape cross-section, a tube with an oval cross-section, or a tube with an ovoid cross-section. The cross-sectional shape of the side rails 24, 26 is the same cross-sectional shape of the base 22. In an embodiment, the first side rail 24 and the second side rail 26 each is in the form of a hollow tube with a circular cross-section, as shown in FIG. 1. The first side rail 24 and the second side rail 26 each may be formed from a rigid material such as a metal or a polymeric material.

Figure 7:
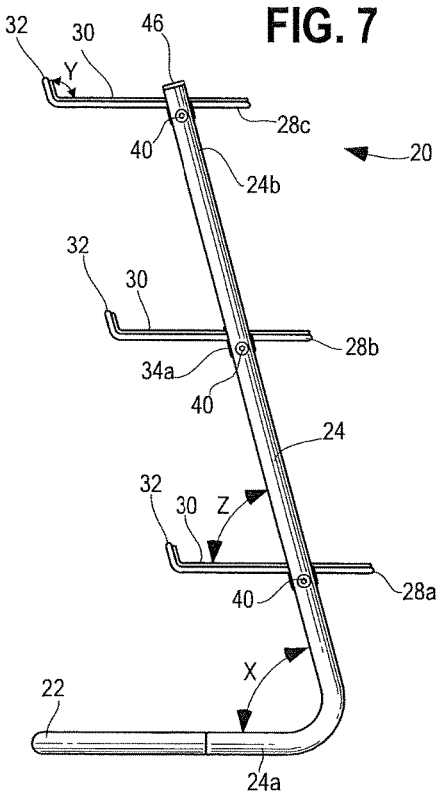
FIG. 7 is a left elevation view of the shoe rack in accordance with an embodiment of the present disclosure.

The first side rail 24 has two ends, an angled first end 24*a* and a second end 24*b*. The angled first end 24*a* is curved at angle, X, as shown in FIG. 7. In an embodiment, angled first end 24*a* is curved at angle, X, from 45°, or 50°, or 55°, or 60°, or 65° to 70°, or 75°, or 80°, or 85°, or less than 90°. The angled first end 24*a* is curved at an angle, X, that is less than 90°. With the preferred angle being 70°.

The angled first end 24*a* of the first side rail 24 includes a connector, such as a female connector or a male connector. The first end 22*a* of the base 22 and the angled first end 24*a* of the first side rail 24 have reciprocal connectors, indicating that one has a female connector and the other has a male connector, the female connector sized to receive the male connector. FIGS. 9-10B depict a first side rail 24 with an angled first end 24*a* having a male connector 48. The male connector 48 is sized to fit within the female connector 50 of the first end 22*a* of the base 22.

In an embodiment, the angled first end 24*a* of the first side rail 24 includes a push-pin opening. In an embodiment, the male connector 48 of the angled first end 24*a* of the first side rail 24 includes a push-pin opening. When the male connector 48 of the angled first end 24*a* of the first side rail 24 is positioned within the female connector 50 of the first end 22*a* of the base 22, the push-pin opening 52 in the base 22 is aligned with the push-pin opening in the first side rail 24, such that a push-pin 44 may extend through the push-pin opening in the first side rail 24 and the push-pin opening 52 in the base 22, as shown in FIG. 10B.

In an embodiment, the first side rail 24 includes a push-pin connector. Each push-pin connector includes a push-pin 44 and a push-pin spring (not shown). In an embodiment, the push-pin spring and the push-pin 44 are located within the first side rail 24, such that the push-pin 44 is aligned with and extends through the push-pin opening in the angled first end 24*a*. The push-pin spring exerts a force on the push-pin 44 such that the push-pin 44 remains extended through the push-pin opening unless a user presses (i.e., pushes) the push-pin 44 and exerts a pressure sufficient to collapse the push-pin spring. Once the user releases the push-pin 44, the push-pin spring forces the push-pin 44 back through the push-pin opening. Push-pin connectors are advantageous because they are detachable connections that do not require the use of a tool to detach the components.

The first side rail 24 is detachably connected to one end of the base 22, such as via a push-pin connector. FIGS. 1 and 10B depict the first side rail 24 detachably connected to the first end 22*a* of the base 22 via a push-pin connector.

In an embodiment, the second end 24*b* of the first side rail 24 includes a side rail end cap 46, as shown in FIG. 1. The side rail end cap 46 is sized to fit within a portion of the second end 24*b* of the first side rail 24. Side rail end caps 46 are advantageous because they cover sharp edges, making the shoe rack 20 safer for a consumer to use. The side rail end cap 46 is formed from a rigid material. A nonlimiting example of a suitable rigid material is a polymeric material.

Figure 2A:
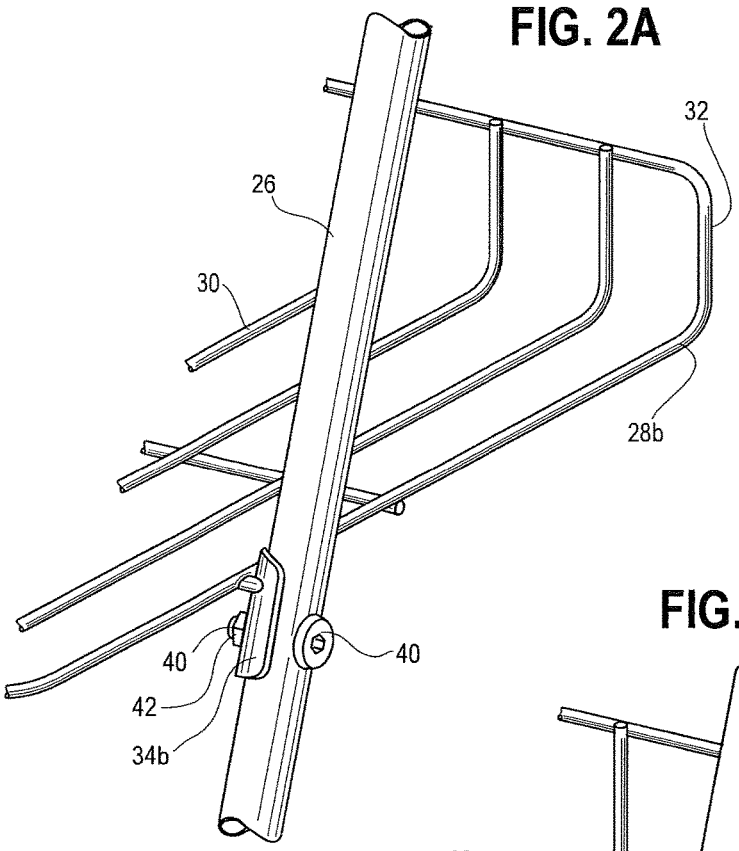
FIG. 2A is an enlarged view of Area 2 of FIG. 1 in accordance with an embodiment of the present disclosure.
Figure 2B:
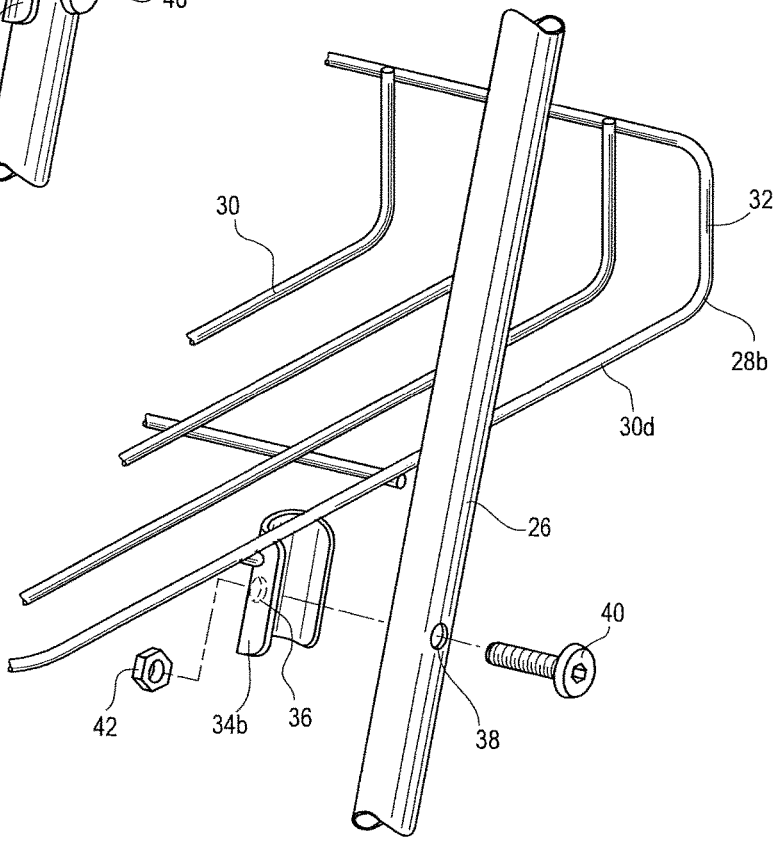
FIG. 2B is an enlarged exploded view of Area 2 of FIG. 1 in accordance with an embodiment of the present disclosure.

The first side rail 24 includes a plurality of threaded openings 38, as shown in FIG. 2B. In an embodiment, the first side rail 24 includes from 2, or 3 to 4, or 5, or 6, or 7, or 8 threaded openings 38. In an embodiment, the first side rail 24 includes 3 threaded openings 38. Each threaded opening 38 extends through the first side rail 24, such that a threaded connector, such as a screw 40, may extend through the first side rail 24. The threaded openings are located between the first angled end 24*a* and the second end 24*b*.

Figure 5:
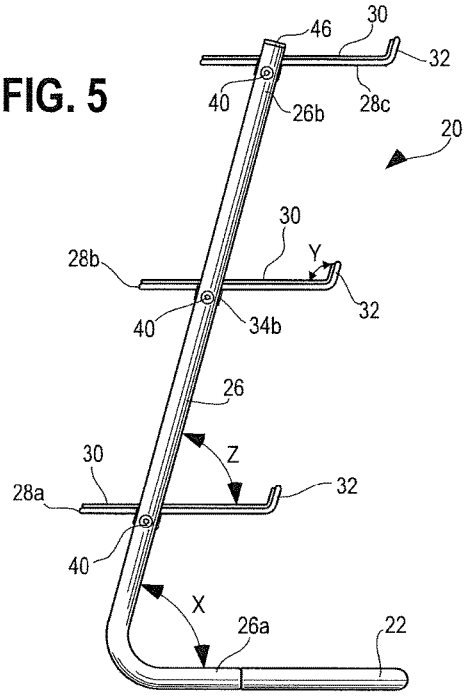
FIG. 5 is a right elevation view of the shoe rack in accordance with an embodiment of the present disclosure.

The second side rail 26 is a mirror-image of the first side rail 26, as shown in FIG. 1. The second side rail 26 has two ends, an angled first end 26*a* and a second end 26*b*. The angled first end 26*a* is curved at angle, X, as shown in FIG. 5. The angled first end 26*a* of the second side rail 26 has the same angle, X, as the angled first end 24*a* of the first side rail 24. In an embodiment, angled first end 26*a* is curved at angle, X, from 45°, or 50°, or 55°, or 60°, or 65° to 70°, or 75°, or 80°, or 85°, or less than 90°. The angled first end 26*a* is curved at an angle, X, that is less than 90°. With the preferred angle being 70°.

The angle, X, is equal to the angle at which the first side rail 24 and the second side rail 26 extend upward from the base 22 when the first side rail 24 and the second side rail 26 each is detachably connected to the base.

The angled first end 26*a* of the second side rail 26 includes a connector, such as a female connector or a male connector. The second end 22*b* of the base 22 and the angled first end 26*a* of the second side rail 26 have reciprocal connectors, indicating that one has a female connector and the other has a male connector, the female connector sized to receive the male connector. In an embodiment, the second side rail 26 has an angled first end 26*a* with a male connector 48, as shown in FIG. 9. The male connector 48 of the second side rail 26 is sized to fit within the female connector 50 of the second end 22*b* of the base 22.

Figure 4:
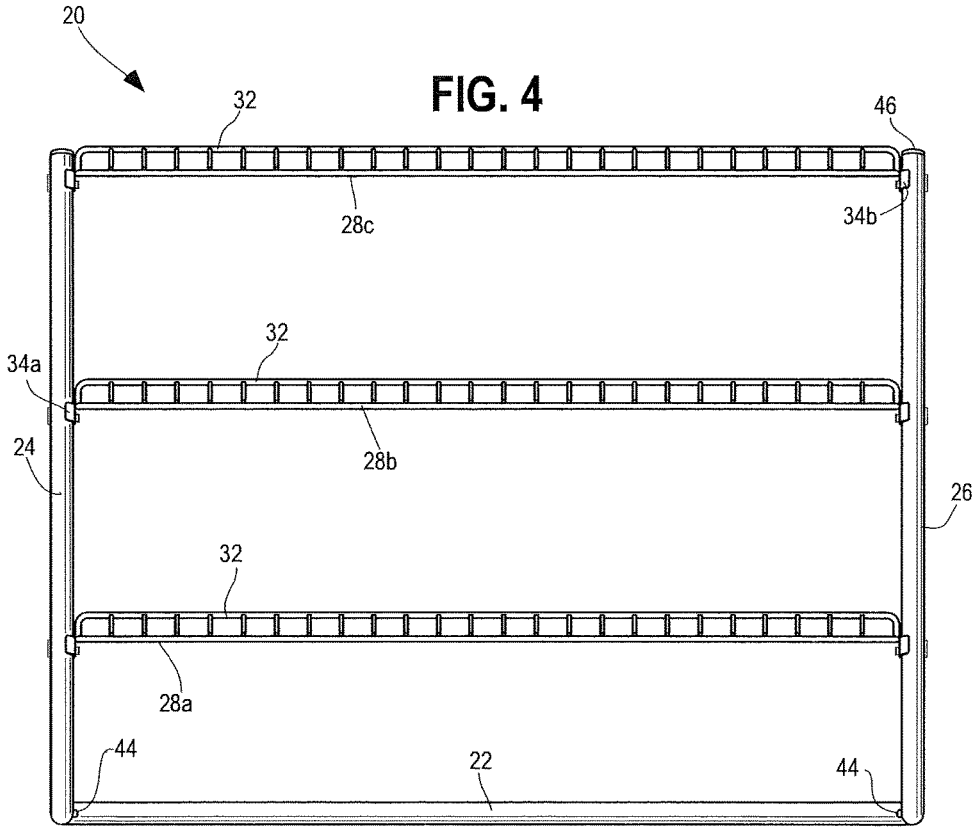
FIG. 4 is a front elevation view of the shoe rack in accordance with an embodiment of the present disclosure.

In an embodiment, the angled first end 26*a* of the second side rail 26 includes a push-pin opening. In an embodiment, the male connector 48 of the angled first end 26*a* of the second side rail 26 includes a push-pin opening. When the male connector 48 of the angled first end 26*a* of the second side rail 26 is positioned within the female connector 50 of the second end 22*b* of the base 22, the push-pin opening 52 in the base 22 is aligned with the push-pin opening in the second side rail 26, such that a push-pin 44 may extend through the push-pin opening in the second side rail 26 and the push-pin opening 52 in the base 22, as shown in FIG. 4.

In an embodiment, the second side rail 26 includes a push-pin connector. Each push-pin connector includes a push-pin 44 and a push-pin spring (not shown). In an embodiment, the push-pin spring and the push-pin 44 are located within the second side rail 26, such that the push-pin 44 is aligned with and extends through the push-pin opening in the angled first end 26*a*. The push-pin spring exerts a force on the push-pin 44 such that the push-pin 44 remains extended through the push-pin opening unless a user presses (i.e., pushes) the push-pin 44 and exerts a pressure sufficient to collapse the push-pin spring. Once the user releases the push-pin 44, the push-pin spring forces the push-pin 44 back through the push-pin opening.

The second side rail 26 is detachably connected to one end of the base 22, such as via a push-pin connector. FIGS. 1 and 4 depict the second side rail 26 detachably connected to the second end 22*b* of the base 22 via a push-pin connector.

In an embodiment, the second end 26*b* of the second side rail 26 includes a side rail end cap 46, as shown in FIG. 1. The side rail end cap 46 is sized to fit within a portion of the second end 26*b* of the second side rail 26.

The second side rail 26 includes a plurality of threaded openings 38. In an embodiment, the second side rail 26 includes from 2, or 3 to 4, or 5, or 6, or 7, or 8 threaded openings 38. In an embodiment, the second side rail 26 includes 3 threaded openings 38. Each threaded opening 38 extends through the second side rail 26, such that a threaded connector, such as a screw 40, may extend through the second side rail 26. The threaded openings are located between the first angled end 26*a* and the second end 26*b*. The first side rail 24 and the second side rail 26 include the same number of threaded openings 38.

C. Shelves

The shoe rack 20 includes a plurality of shelves. In an embodiment, the shoe rack 20 includes from 2, or 3 to 4, or 5, or 6, or 7, or 8 shelves. In an embodiment, the shoe rack 20 includes 3 shelves, or at least 3 shelves. FIG. 1 depicts a shoe rack 20 with three shelves, a bottom shelf 28*a*, a middle shelf 28*b*, and a top shelf 28*c*. It is understood that the present description with respect to a shoe rack 20 with a bottom shelf 28*a*, a middle shelf 28*b*, and a top shelf 28*c* applies equally to a shoe rack with 2 shelves, or with more than 3 shelves. As used herein, the "bottom shelf" is the shelf positioned closest to the ground when the shoe rack 20 is assembled and located on the ground. The "top shelf" is the shelf positioned farthest from the ground when the shoe rack 20 is assembled and located on the ground. The "middle shelf" is positioned between the bottom shelf and the top shelf. The shoe rack 20 may or may not include a middle shelf. In an embodiment, the shoe rack includes a plurality of middle shelves.

Each shelf (28*a*, 28*b*, 28*c*) includes a shelf platform 30 and two joints 34*a*, 34*b*, as shown in FIGS. 1-2B.

Figure 11:
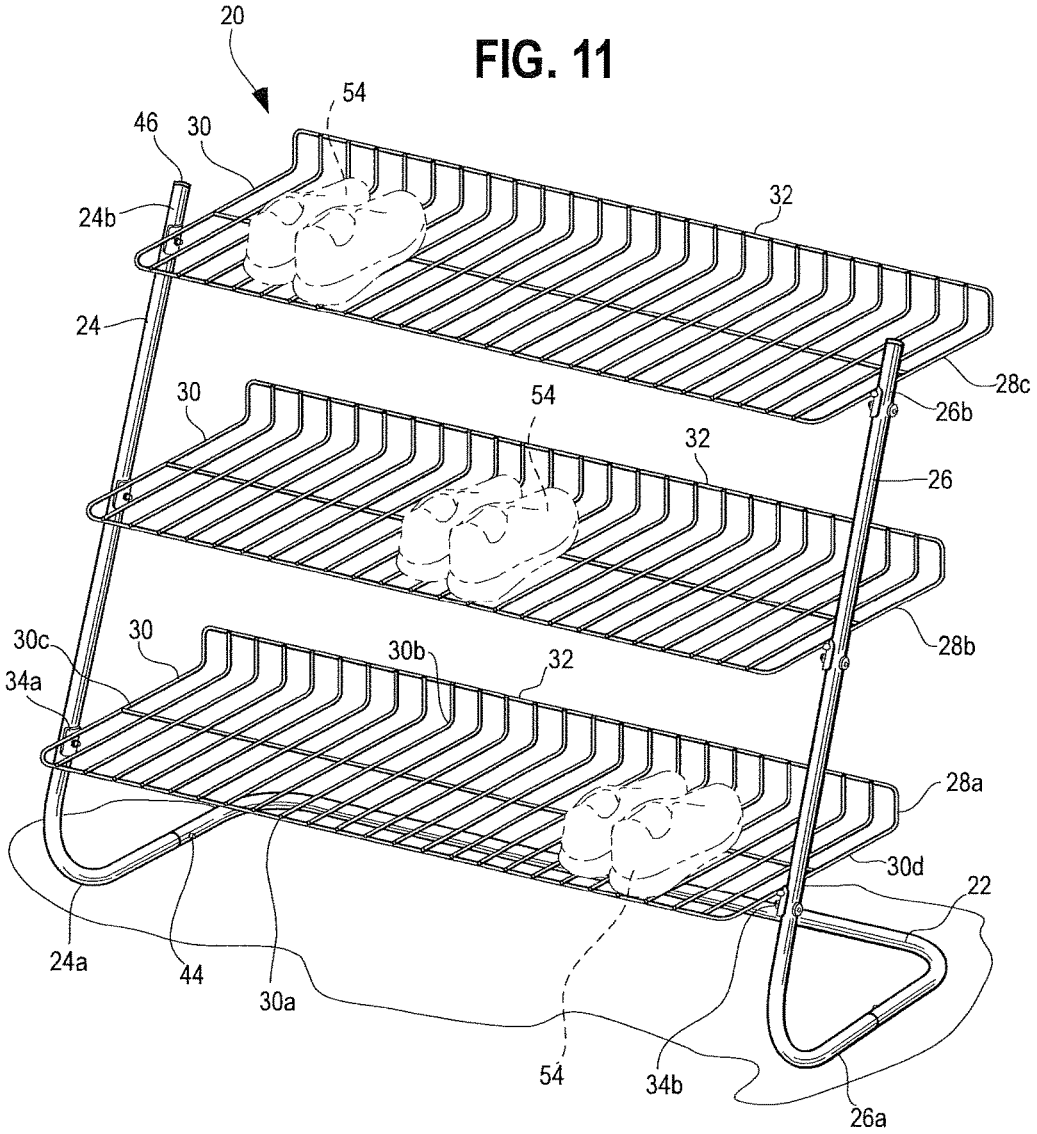
FIG. 11 is a perspective view of a shoe rack with shoes in accordance with an embodiment of the present disclosure.

A "shelf platform" is a surface upon which a user may place an item, such as a shoe 54, as shown in FIG. 11. When the shoe rack 20 is assembled and placed on the floor, the shelf platform 30 extends parallel to the ground, and parallel to the rear side 22*c* of the base 22, as shown in FIGS. 4-7. The shelf platform 30 has a polygonal shape, as shown in FIGS. 1 and 11. The shelf platform 30 is formed from a rigid material. Nonlimiting examples of suitable rigid material includes metal materials such as wire, polymeric materials, wood, and particle board. FIGS. 1-9 and 11 depict a shoe rack 20 with shelf platforms 30 made from metal wire. As shown, the metal wire is arranged in a grid such that a user may place shoes 54 upon the shelf platform 30 without the shoes 54 falling between the metal wires.

In an embodiment, the shelf platform 30 has a polygonal shape with a front side 30*a*, a rear side 30*b*, a first end 30*c*, and a second end 30*d*, as shown in FIG. 11. The front side 30*a* is opposite the rear side 30*b*, and the first end 30*c* is opposite the second end 30*d*.

In an embodiment, the rear side 30*b* of the shelf platform 30 is connected to a shelf wall 32. The shelf platform 30 and the shelf wall 32 may have an integral design or a composite design. An "integral design" is formed from one piece of rigid material, such as a molded piece. A "composite design" is formed from more than one distinct piece (or part), which upon assembly are combined to form the shelf. FIG. 11 depicts a shelf platform 30 and a shelf wall 32 with an integral design. The shelf wall 32 extends upward from the shelf platform 30 at an angle, Y, as shown in FIG. 5. In an embodiment, shelf wall 32 extends upward from the shelf platform 30 at an angle, Y, from 90°, or 95° to 100°, or 105°, or 110°, or 115°, or 120°, or 125°, or 130°. The shelf wall 32 advantageously prevents shoes 54 from falling off the rear side 30*b* of the shelf platform 30.

Each shelf has a first joint 34*a* and a second joint 34*b*. A "joint" is a connector extending from the shelf platform 30 shaped to receive a portion of a side rail (24, 26), the joint having a threaded opening 36. FIG. 2B depicts a joint 34*b* extending from the second end 30*d* of the shelf platform 30, the joint shaped to receive, such as wrap around, a portion of the second side rail 26. The joint 34*b* has a threaded opening 36. The shelf platform 30 and each joint 34*a*, 34*b* may have an integral design or a composite design. FIG. 2B depicts a shelf platform 30 and a second joint 34*b* having an integral design.

The first joint 34*a* is detachably connected to the first side rail 24. In an embodiment, the first joint 34*a* is detachably connected to the first side rail 24 via a threaded connector, such as a screw 40, as shown in FIG. 7. In an embodiment, the first joint 34*a* is positioned such that its threaded opening 36 aligns with a threaded opening 38 in the first side rail 24 so that a screw 40 may extend through the threaded opening 38 in the first side rail 24 and the threaded opening 36 in the first joint 34*a* to fasten the first joint 34*a* (and further, the shelf) to the first side rail 24. In an embodiment, the first joint 34*a* (and further, the shelf) is detachably connected to the first side rail 24 with a screw 40 and a hex nut 42.

The second joint 34*b* is detachably connected to the second side rail 26. In an embodiment, the second joint 34*b* is detachably connected to the second side rail 26 via a threaded connector, such as a screw 40, as shown in FIG. 2A. In an embodiment, the second joint 34*b* is positioned such that its threaded opening 36 aligns with a threaded opening 38 in the second side rail 24 so that a screw 40 may extend through the threaded opening 38 in the second side rail 26 and the threaded opening 36 in the second joint 34*b* to fasten the second joint 34*b* (and further, the shelf) to the second side rail 26. In an embodiment, the second joint 34*b* (and further, the shelf) is detachably connected to the second side rail 26 with a screw 40 and a hex nut 42, as shown in FIG. 2A.

When the first joint 34*a* (and further, the shelf) is detachably connected to the first side rail 24, and the second joint 34*b* (and further, the shelf) is detachably connected to the second side rail 26, the shelf platform 30 is parallel to the ground, as shown in FIGS. 4-7. Thus, when the first joint 34*a* (and further, the shelf) is detachably connected to the first side rail 24, and the second joint 34*b* (and further, the shelf) is detachably connected to the second side rail 26, the shelf platform 30 is parallel to the ground, and the shelf platform 30 is at an angle, Z, to each side rail, as shown in FIGS. 5 and 7. The angle, Z, is equal to the angle, X, of the angled first end 26*a* of the second side rail 26 and the angled first end 24*a* of the first side rail 24. In an embodiment, the shelf platform 30 is at an angle, Z, to each side rail, that is from 45°, or 50°, or 55°, or 60°, or 65° to 70°, or 75°, or 80°, or 85°, or less than 90°. The shelf platform 30 is at an angle, Z, to each side rail, that is less than 90°.

Figure 3:
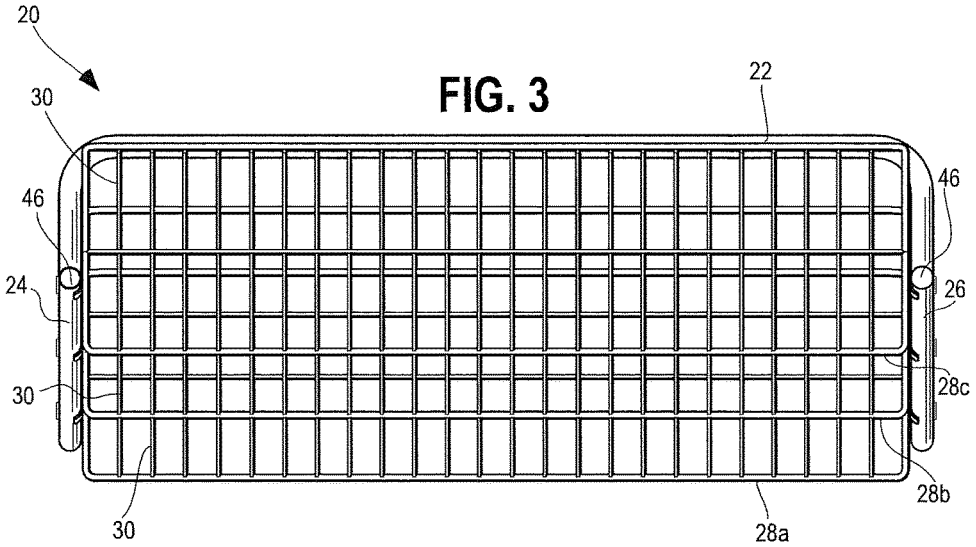
FIG. 3 is a top plan view of the shoe rack in accordance with an embodiment of the present disclosure.
Figure 8:
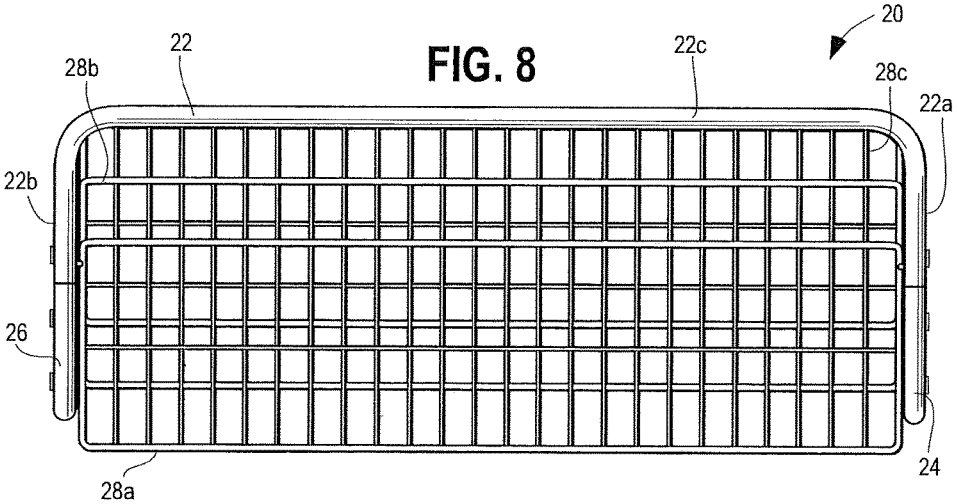
FIG. 8 is a bottom plan view of the shoe rack in accordance with an embodiment of the present disclosure.

The position of the first joint 34*a* with respect to the shelf platform's front side 30*a*, rear side 30*b*, first end 30*c*, and second end 30*d* is the same on each shelf (28*a*, 28*b*, 28*c*), as shown in FIGS. 7 and 11. The position of the second joint 34*b* with respect to the shelf platform's front side 30*a*, rear side 30*b*, first end 30*c*, and second end 30*d* is the same on each shelf (28*a*, 28*b*, 28*c*), as shown in FIGS. 5 and 11. Due to the angle, X, at which each side rail (24, 26) extends upward from the base 22, a user standing in front of the shoe rack 20 is able to see shoes 54 on each shelf (28*a*, 28*b*, 28*c*) of the shoe rack 20 without bending down. In fact, a user would be able to view the shoe rack 20 from directly above the shoe rack 20, and still see shoes 54 stored on each shelf (28*a*, 28*b*, 28*c*), as evidenced by the top plan view of the shoe rack depicted in FIG. 3, in which the shelf platform 30 of each shelf (28*a*, 28*b*, 28*c*) is visible. The angled side rails (24, 26) provide a staggered effect on the shelves, as shown in FIGS. 3 and 8 (showing a bottom plan view of the shoe rack 20).

D. Shoe Rack

As shown in FIGS. 1-11, a shoe rack 20 is provided that includes a base 22 detachably connected to a first side rail 24 and a second side rail 26. The first side rail 24 and the second side rail 26 extend upward from the base at an angle, X, from 45°, or 50°, or 55°, or 60°, or 65° to 70°, or 75°, or 80°, or 85°, or less than 90°. The shoe rack 20 includes a plurality of shelves (28*a*, 28*b*, 28*c*). Each shelf (28*a*, 28*b*, 28*c*) includes a shelf platform 30. FIGS. 1-11 depict shelves with a shelf platform 30 made from a wire grid. Each shelf (28*a*, 28*b*, 28*c*) has a first joint 34*a* detachably connected to the first side rail 24, and a second joint 34*b* detachably connected to the second side rail 26.

In an embodiment, the first side rail 24 is detachably connected to a first end 22*a* of the base 22, and the second side rail 26 is detachably connected to the second end 22*b* of the base 22, and the first side rail 24 and the second side rail 26 each is detachably connected to a plurality of shelves (28*a*, 28*b*, 28*c*), each shelf having a first joint 34*a* detachably connected to the first side rail 24 and a second joint detachably connected to the second side rail 26. Each shelf (28*a*, 28*b*, 28*c*) has a shelf platform 30. The shelves (28*a*, 28*b*, 28*c*) are vertically arranged with respect to one another such that shoes 54 may be placed upon each shelf platform 30, as shown in FIG. 11.

The present shoe rack 20 with a detachable base 22, first side rail 24, second side rail 26, and shelves (28*a*, 28*b*, 28*c*) is easy to transport by having a compact packaging size. Comparative shoe racks without detachable components are unable to achieve the compact packaging size exhibited by the present shoe rack 20. Further, the present shoe rack 20 is simple for a user to assemble, and disassemble, after purchase.

The present shoe rack 20 with a staggered shelf arrangement advantageously allows a user standing in front of the shoe rack 20 to be able to see shoes 54 on each shelf (28*a*, 28*b*, 28*c*) of the shoe rack 20 without bending down.

Figure 12:
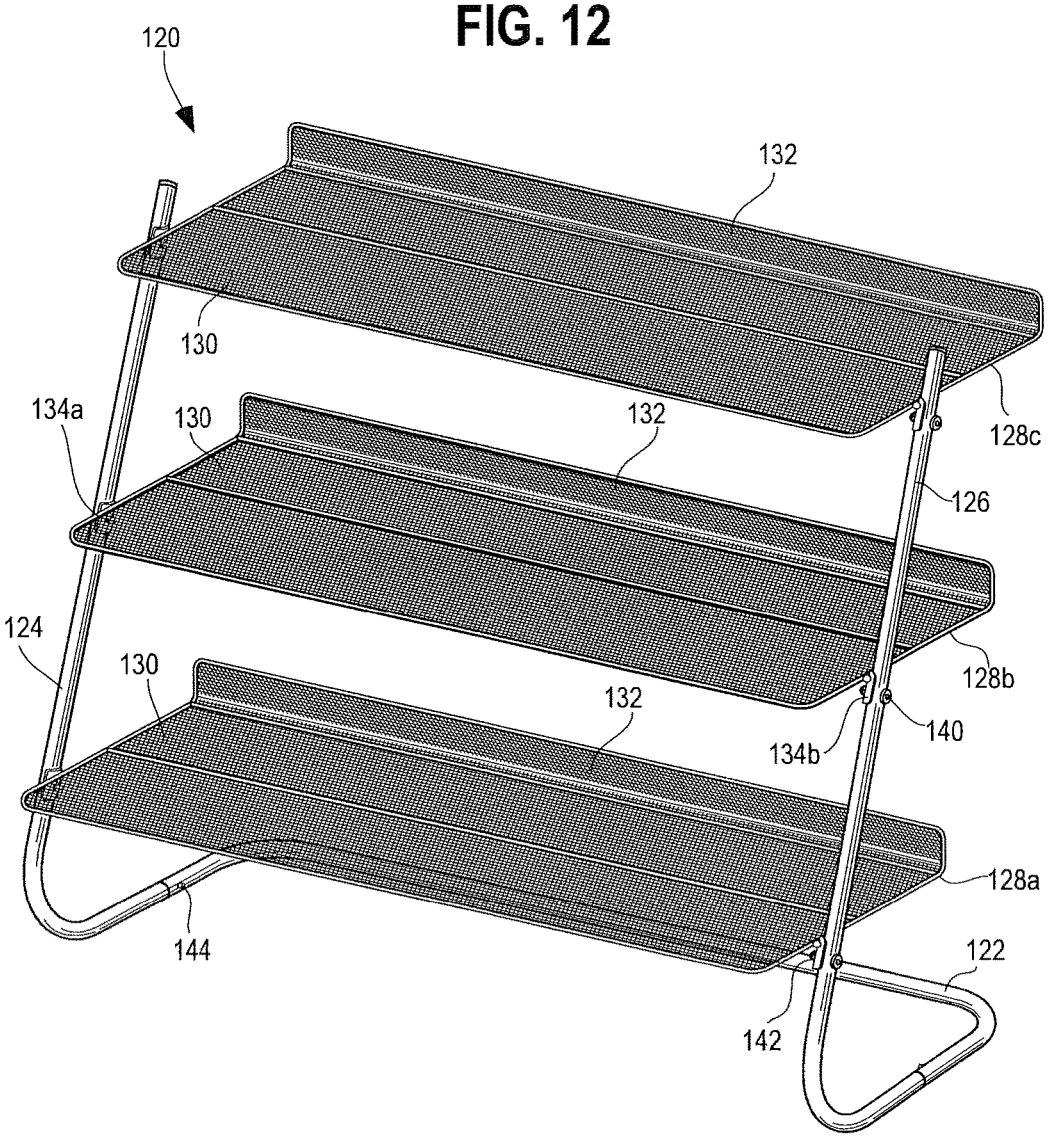
FIG. 12 is a perspective view of a shoe rack in accordance with another embodiment of the present disclosure.
Figure 13:
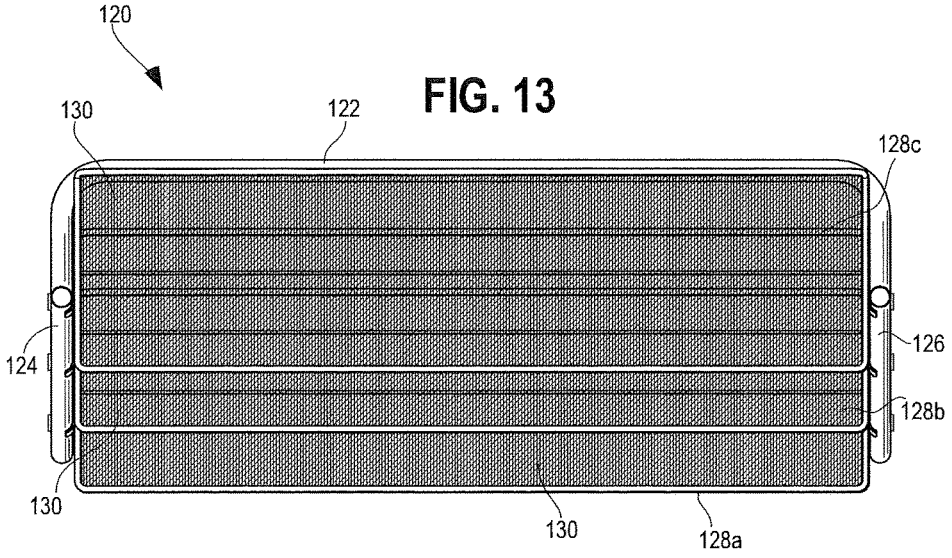
FIG. 13 is a top plan view of a shoe rack in accordance with an embodiment of the present disclosure.
Figure 14:
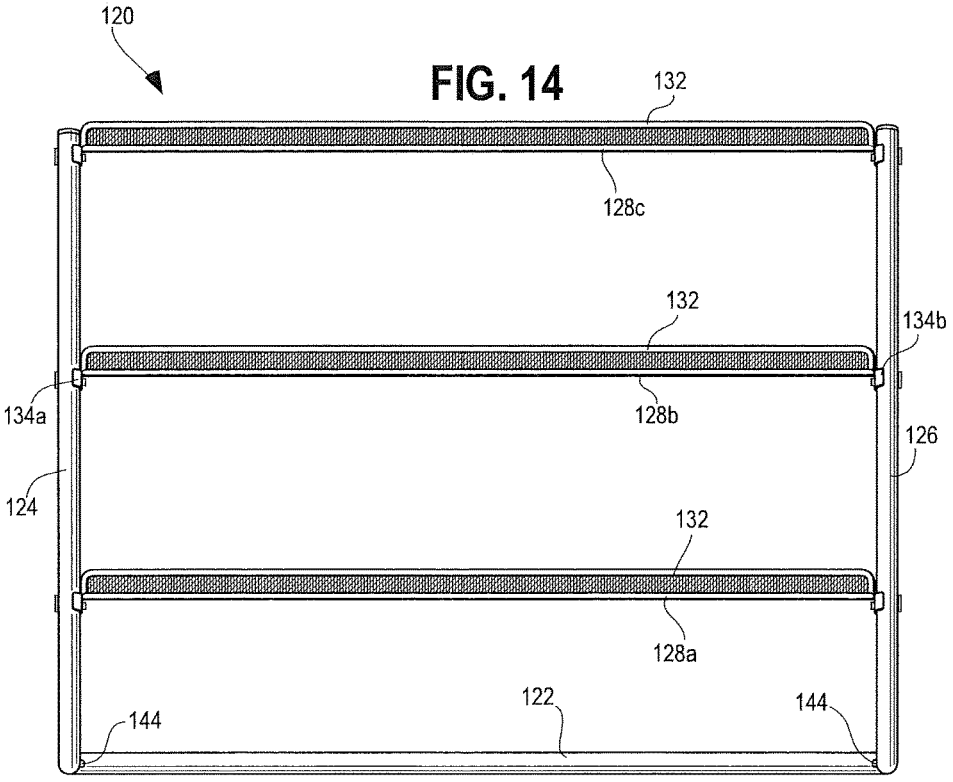
FIG. 14 is a front elevation view of a shoe rack in accordance with an embodiment of the present disclosure.

The present disclosure also provides for a shoe rack 120 with a plurality of shelves (128*a*, 128*b*, 128*c*) formed from a metal mesh, as shown in FIGS. 12-14. The shoe rack 120 includes a base 122 detachably connected to a first side rail 124 and a second side rail 126, as shown in FIG. 12. The first side rail 124 is detachably connected to the base 122 via a push-pin connection 144, as shown in FIG. 14. The second side rail 126 is detachably connected to the base via a push-pin connection 144. The first side rail 124 and the second side rail 126 extend upward from the base at an angle from 45°, or 50°, or 55°, or 60°, or 65° to 70°, or 75°, or 80°, or 85°, or less than 90°. The shoe rack 120 includes a plurality of shelves (128*a*, 128*b*, 128*c*). Each shelf (128*a*, 128*b*, 128*c*) includes a shelf platform 130 and a shelf wall 132. FIGS. 12-14 depict shelves with a shelf platform 130 made from a wire mesh. The shelf wall 132 and the shelf platform 130 have an integral design. Thus, the shelf wall 132 and the shelf platform 130 are formed from a single piece of wire mesh. Each shelf (128*a*, 128*b*, 128*c*) has a first joint 134*a* detachably connected to the first side rail 124, and a second joint 134*b* detachably connected to the second side rail 126. The first joint 134*a* is detachably connected to the first side rail 124 via a screw 140 and a hex nut 142. The second joint 134*b* is detachably connected to the second side rail 126 via a screw 140 and a hex nut 142. The base 122 and each shelf platform 130 extends parallel to one another, as shown in FIG. 14.

The shoe rack 120 has a staggered shelf arrangement, as shown in FIG. 13. The shoe rack 120 advantageously allows a user standing in front of the shoe rack 120 to be able to see shoes on each shelf (128*a*, 128*b*, 128*c*) of the shoe rack 120 without bending down.

Figure 15:
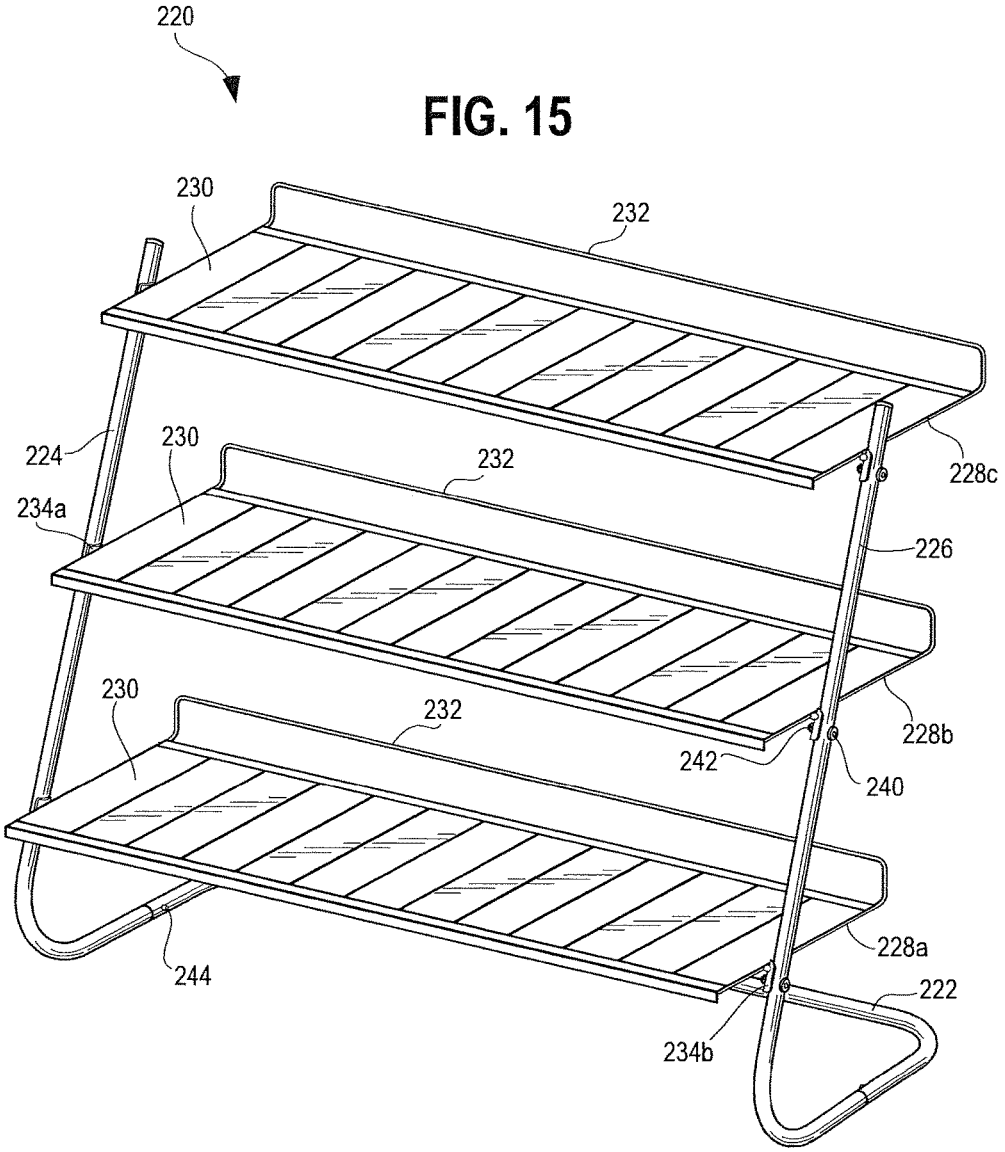
FIG. 15 is a perspective view of a shoe rack in accordance with another embodiment of the present disclosure.
Figure 16:
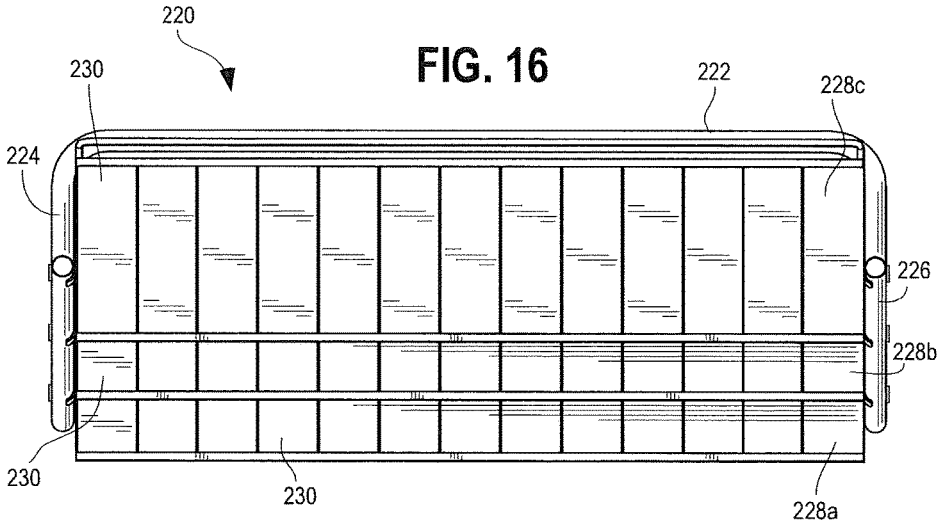
FIG. 16 is a top plan view of a shoe rack in accordance with an embodiment of the present disclosure.
Figure 17:
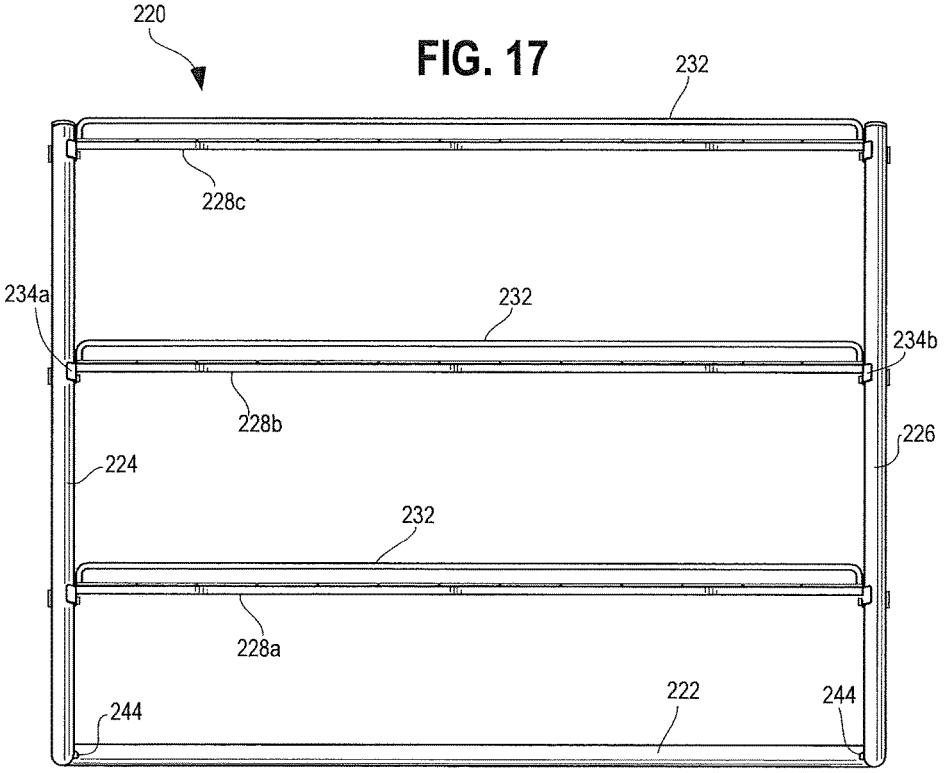
FIG. 17 is a front elevation view of a shoe rack in accordance with an embodiment of the present disclosure.
Figure 18:
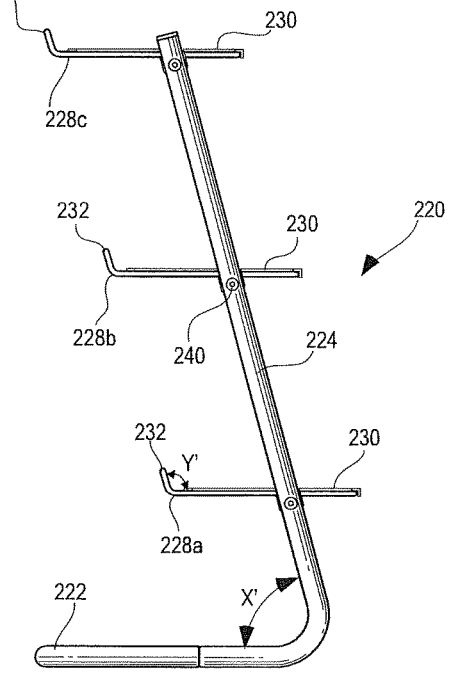
FIG. 18 is a left elevation view of a shoe rack in accordance with an embodiment of the present disclosure.
Figure 19:
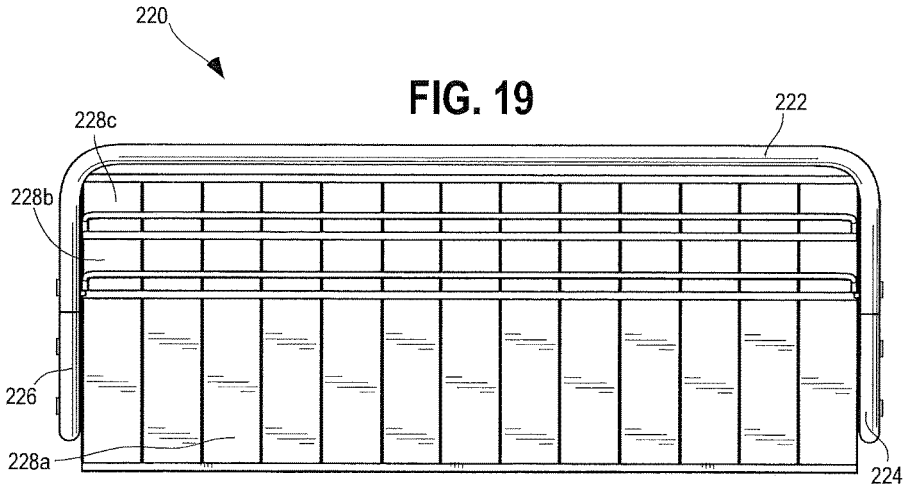
FIG. 19 is a bottom plan view of a shoe rack in accordance with an embodiment of the present disclosure.

The present disclosure also provides for a shoe rack 220 with a plurality of shelves (228*a*, 228*b*, 228*c*) formed from a polymeric material, as shown in FIGS. 15-19. The shoe rack 220 includes a base 222 detachably connected to a first side rail 224 and a second side rail 226, as shown in FIG. 15. The first side rail 224 is detachably connected to the base 222 via a push-pin connection 244, as shown in FIG. 17. The second side rail 226 is detachably connected to the base via a push-pin connection 244. The first side rail 224 and the second side rail 226 extend upward from the base at an angle, X', from 45°, or 50°, or 55°, or 60°, or 65° to 70°, or 75°, or 80°, or 85°, or less than 90°, as shown in FIG. 18. The shoe rack 220 includes a plurality of shelves (228*a*, 228*b*, 228*c*). Each shelf (228*a*, 228*b*, 228*c*) includes a shelf platform 230 and a shelf wall 232. FIGS. 15-19 depict shelves with a shelf platform 230 made from a polymeric material. The shelf platform 230 formed from a polymeric material may or may not be texturized. The shelf platform 230 formed from a polymeric material may have an integral design or a composite design. A shelf platform 230 formed from a polymeric material with an integral design is formed from a single piece of polymeric material. A shelf platform 230 formed from a polymeric material with a composite design is formed from two or more pieces of polymeric material, and may or may not have a slat design. A "slat design" is a composite design formed from at least two pieces of polymeric material that overlap or fit into each other. FIGS. 15,16 and 19 depict a shelf platform 230 formed from a polymeric material with a slat design. The shelf wall 230 is formed from a metal wire. Thus, the shelf wall 232 and the shelf platform 230 have a composite design. The shelf wall 232 extends upward from the shelf platform 230 at an angle, Y', as shown in FIG. 18. In an embodiment, shelf wall 232 extends upward from the shelf platform 230 at an angle, Y', from 90°, or 95° to 100°, or 105°, or 110°, or 115°, or 120°, or 125°, or 130°.

Each shelf (228*a*, 228*b*, 228*c*) has a first joint 234*a* detachably connected to the first side rail 224, and a second joint 234*b* detachably connected to the second side rail 226, as shown in FIG. 17. The first joint 234*a* is detachably connected to the first side rail 224 via a screw 240 and a hex nut 242. The second joint 234*b* is detachably connected to the second side rail 226 via a screw 240 and a hex nut 242, as shown in FIG. 15. The base 222 and each shelf platform 230 extends parallel to one another, as shown in FIG. 17.

The shoe rack 220 has a staggered shelf arrangement, as shown in FIGS. 16 and 19. The shoe rack 220 advantageously allows a user standing in front of the shoe rack 220 to be able to see shoes on each shelf (228*a*, 228*b*, 228*c*) of the shoe rack 220 without bending down.

E. Kit

The present disclosure also provides a kit for a shoe rack. The kit includes:

a base;

a first side rail and a second side rail, each side rail comprising an angled first end, the angled first end having an angle from 45 degrees to less than 90 degrees;

a plurality of shelves, each shelf comprising a shelf platform, a first joint, and a second joint; and a plurality of fasteners.

In an embodiment, the kit includes any combination of the shoe rack components disclosed herein.

The kit includes a base 22, a first side rail 24, and a second side rail 26. In an embodiment, the base 22 has a first end 22*a* and a second end 22*b*, and each of the first end 22*a* and the second end 22*b* has a female connector 50, as shown in FIG. 9. In an embodiment, each side rail (24, 26) has an angled first end 24*a* having an angle, X, from 45°, or 50°, or 55°, or 60°, or 65° to 70°, or 75°, or 80°, or 85°, or less than 90°, as shown in FIGS. 5 and 7. In an embodiment, the angled first end 24*a* of each of the first side rail 24 and the second side rail 26 includes a male connector 48 and a push-pin connector 44, as shown in FIGS. 9 and 10A. In an embodiment, the first end 22*a* of the base 22 has (i) a female connector 50 sized to receive the male connector 48 of the first side rail 24 and (ii) a push-pin opening 52 sized to receive the push-pin connector 44 of the first side rail 24. In an embodiment, the second end 22*b* of the base 22 has (i) a female connector 50 sized to receive the male connector 48 of the second side rail 26 and (ii) an push-pin opening 52 sized to receive the push-pin connector 44 of the second side rail 26.

The kit includes a plurality of shelves. In an embodiment, the kit includes from 2, or 3 to 4, or 5, or 6, or 7, or 8 shelves. In an embodiment, the kit includes 3 shelves (28*a*, 28*b*, 28*c*). Each shelf (28*a*, 28*b*, 28*c*) has a shelf platform 30, a first joint 34*a*, and a second joint 34*b*. The first joint 34*a* and the second joint 34*b* are positioned at opposite ends of the shelf platform 30, as shown in FIG. 1.

The kit also includes a plurality of fasteners. "Fasteners" includes push-pin connectors, threaded connectors, and combinations thereof. The fasteners facilitate detachable connections between the base 22, the first side rail 24, the second side rail 26, and the shelves (28*a*, 28*b*, 28*c*). In an embodiment, the kit includes a plurality of push-pin connectors. Push-pin connectors include push-pins 44 and push-pin springs. In an embodiment, the kit includes two push-pin connectors. In an embodiment, the kit includes a plurality of threaded connectors. A nonlimiting example of a threaded connector is a screw 40, as shown in FIG. 2B. In an embodiment, the kit includes from 6 to 7, or 8, or 9, or 10 screws 40. In an embodiment, the kit includes 6 screws 40. In an embodiment, the kit includes a plurality of hex nuts 42, as shown in FIG. 2B. In an embodiment, the kit includes from 6 to 7, or 8, or 9, or 10 hex nuts 42. In another embodiment, the kit includes the same number of screws 40 and hex nuts 42.

In an embodiment, the kit includes a plurality of side rail end caps 46, as shown in FIG. 1. In an embodiment, the kit includes from 2 to 3, or 4 side rail end caps 46. In an embodiment, the kit includes 2 side rail end caps 46.

In an embodiment, the kit includes a tool, or a plurality of tools to assist a user in assembling the shoe rack. Nonlimiting examples of suitable tools include a screw driver, a wrench, and combinations thereof.

In an embodiment, the kit is contained in a package. Nonlimiting examples of suitable packages include boxes such as cardboard boxes. The package allows for easy transport of the kit.

The present kit advantageously has a compact packaging size. Further, the present kit is simple for a user to assemble into a shoe rack after purchase.

Definitions

The term "detachably connected" refers to two components reversibly connected, or reversibly fastened, to each other. A nonlimiting example of a detachable connection, or a detachable fastening, is a push-pin connector.

The term "parallel," as used herein, indicates two components extend in the same direction and never intersect.

A "push-pin opening" is a void in a wall sized to receive a push-pin. The push-pin opening allows the push-pin to extend through the wall.

A "threaded opening" is a void in a wall sized to receive a threaded connector, such as a screw. The threaded opening allows the threaded connector to extend through the wall.

It is specifically intended that the present disclosure not be limited to the embodiments and illustrations contained herein, but include modified forms of those embodiments including portions of the embodiments and combinations of elements of different embodiments as come within the scope of the following claims.

We claim:

1. A shoe rack comprising:

a base rail having a first end and a second end, the base rail being detachably connected to and joining a first side rail and a second side rail, the first side rail and the second side rail each extending upwardly at an angle relative to the base rail, wherein the angle is from 45 degrees to less than 90 degrees, wherein the first side rail includes a first top end, a first curved portion, and a first bottom end, wherein the second side rail includes a second top end, a second curved portion, and a second bottom end; wherein the first curved portion is located between the first top end and the first bottom end; wherein the second curved portion is located between the second top end and the second bottom end; wherein the first and second bottom ends of the first and second side rails mate with the first and second ends of the base rail respectively to connect the base rail to the first and second side rails; wherein a portion of the first side rail and a portion of the second side rail are each configured to be parallel to and rest upon a floor surface; and a plurality of shelves, each shelf comprising:

(a) a shelf platform having a front side, a rear side, a first end, and a second end;

(b) a first joint extending from the shelf platform, wherein the first joint defines an arcuate shape that receives a portion of the first side rail and is detachably connected to the first side rail to mount the shelf platform to the first side rail, wherein the first joint is generally diagonal relative to the shelf platform, wherein a portion of the first joint is located below the shelf platform; wherein a first fastener extends through the first side rail and the first joint to secure the first joint to the first side rail; and (c) a second joint extending from the shelf platform, wherein the second joint defines an arcuate shape that receives a portion of the second side rail and is detachably connected to the second side rail to mount the shelf platform to the second side rail, wherein the first joint is generally diagonal relative to the shelf platform, wherein a portion of the second joint is located below the shelf platform, wherein a second fastener extends through the second side rail and the second joint to secure the second joint to the second side rail.

2. The shoe rack of claim 1, wherein the plurality of shelves comprises at least three shelves.

3. The shoe rack of claim 1, wherein each shelf further comprises a shelf wall, each shelf wall extending upwardly from each shelf platform respectively at an angle.

4. The shoe rack of claim 1, wherein each shelf platform of each shelf is configured to be parallel to the floor surface.

5. The shoe rack of claim 1, wherein each shelf platform comprises a wire grid.

6. The shoe rack of claim 1, wherein each shelf platform comprises a metal mesh.

7. The shoe rack of claim 1, wherein each shelf platform comprises polymeric slats.

8. The shoe rack of claim 1, wherein each first joint extends from each first end of each shelf respectively, wherein each first end of each shelf extends between each front side and each rear side of each shelf respectively.

* * * * *